United States Patent [19]

Truher et al.

[11] 4,220,984

[45] Sep. 2, 1980

[54] ILLUMINATION DEVICE FOR A WATERBED

[76] Inventors: Michael B. Truher; Sheryl L. Truher, both of 499 Ellis St., Pasadena, Calif. 91105

[21] Appl. No.: 10,612

[22] Filed: Feb. 9, 1979

[51] Int. Cl.[2] ..... A47B 23/06

[52] U.S. Cl. ..... 362/130; 5/451

[58] Field of Search ..... 362/130, 131; 5/451

[56] References Cited

U.S. PATENT DOCUMENTS

| | | | |
|---|---|---|---|
| 1,760,301 | 5/1930 | Dougherty | 362/130 |
| 2,290,866 | 7/1942 | Cunard | 362/130 |
| 2,418,877 | 4/1947 | Gustafson | 362/130 |
| 3,746,835 | 7/1973 | Yu | 5/451 |
| 4,114,215 | 9/1978 | Santo | 5/451 |

*Primary Examiner*—Donald P. Walsh

*Attorney, Agent, or Firm*—W. Edward Johansen

[57] ABSTRACT

The present invention is an illumination device for use in combination with a waterbed which includes a plastic membrane which takes the shape of a mattress when it is filled with water and which is adapted to be filled with water and a frame having a headboard, four legs and base which is adapted to receive the elastic membrane after it has been filled with water. The illumination device includes a light source which is optically coupled to the water in the plastic membrane through the plastic membrane and which is mechanically coupled to the frame; and a transformer which has an on-off switch which is electrically coupled to a wall outlet and a transformer for stepping down the current through said on-off switch. The light source includes a lamp which is electrically coupled to the transformer and a prism-shape container in which the lamp is disposed and through a glass sidewall of which the lamp is optically coupled to the water in the plastic membrane.

3 Claims, 3 Drawing Figures

ILLUMINATION DEVICE FOR A WATERBED

BACKGROUND OF THE INVENTION

1. Field of the Invention

The present invention relates to waterbeds and more particularly to lighting accessories for waterbeds.

2. Description of the Prior Art

In a time when scientific progress touches our lives every day in many varied ways, one fundamental area of concern remains substantially untouched; that is the surface upon which we sleep. Progression from the straw mat to the stuffed mattress to the inner spring mattress was more evolutionary than inventive. Little real effort has been directed to evaluating the fundamental principles necessary to improve the basic quality of the rest obtained on the common sleep surface.

Recently, however, medical studies have recognized that floatation type body support systems provide an effective alternative to other known sleep surfaces. The studies were originally directed to preventing decubitus ulcerations (commonly called bed sores) in bedridden patients. Since it was considered that the sores were caused by pressure points between the body and its support surface, it was felt that an equalized pressure distribution would elevate the local pressure points. A floatation type body support system was found to accomplish such pressure distribution. Moreover, it was determined that in addition to relieving the occurrence of bed sores, the quality of the rest which the patients enjoyed was markedly improved.

After it was realized that the improved quality of rest generated by the floatation type body support systems had practical universal application, this sleep surface, now known commonly as the waterbed, was made widely available to the general public. With the knowledge that approximately one-third of the life of an average adult is spent in the bedroom, efforts have been made to improve the already superior rest giving qualities of the waterbed. Any such improvement has marked benefits since it has been shown that both physical and mental well being are aided by ample rest periods. Some attempted improvements have included heating the fluid within the waterbed (see U.S. Pat. No. 3,585,356), or causing the fluid to vibrate (see U.S. Pat. No. 3,872,526). There has, however, been no attempt to completely assess all the variables effecting rest, nor any mechanism variables to his individual taste.

U.S. Pat. No. 4,114,215, entitled Unitary Accessory Control for a Waterbed, issued to Phillip J. Santo on Sept. 19, 1978, teaches a unitary accessory control for a waterbed fixed to the waterbed frame. Within the unitary accessory control are such accessories as a pump for filling (emptying) the waterbed, a heater, a vibrator, a sound system and a mechanism to control the environment of the room in which the waterbed is located. The user can thus regulate to his taste, the temperature and degree of motion of his sleep surface, and even change these variables at will. Additionally, he may create a total surrounding environment completely of his own choosing as to sound and/or room lighting and temperature without moving from his sleep surface.

U.S. Pat. No. 4,107,799, entitled Waterbed and Frame with Pliant Supporting Sides, issued to Everette M. Lambert on Apr. 22, 1978, teaches an improvement for use in a frame for a fluid filled mattress. The frame has a horizontally flexible bulkhead about the frame periphery. The improvement includes a longitudinally resilient retaining mechanism secured under tension to opposing peripheral portions of the bulkhead and adapted to support from below the mattress for minimizing horizontal flexture of the bulkhead.

Other patents on waterbeds include U.S. Pat. No. 4,015,299, U.S. Pat. No. 4,064,579, and U.S. Pat. No. 4,025,975. All of these patents teach the construction of waterbeds.

Although waterbeds have been used by people with medical problems, the major portion of the number of people using waterbeds is made up of those people each of whom enjoys the aesthetic pleasure of sleeping on a waterbed. None of the above cited patents teach accessories that increase the aesthetic pleasure of a waterbed.

SUMMARY OF THE INVENTION

In view of the foregoing factors and conditions characteristic of the prior art it is the primary object of the present invention to provide a lighting accessory for a waterbed which will increase the aesthetic pleasure of sleeping on a waterbed.

In accordance with the preferred embodiment of the present invention an illumination device for use in combination with a waterbed which includes a plastic membrane which takes the shape of a mattress when it is filled with water and which is adapted to be filled with water and a frame having a headboard, four legs and base which is adapted to receive the elastic membrane after it has been filled with water is described. The illumination device includes a light source which is optically coupled to the water in the plastic membrane through the plastic membrane and which is mechanically coupled to the frame; and a transformer which has an on-off switch which is electrically coupled to a wall outlet and a transformer for stepping down the current through said on-off switch. The light source includes a lamp which is electrically coupled to the transformer and a prism-shape container in which the lamp is disposed and through a glass sidewall of which the lamp is optically coupled to the water in the plastic membrane.

The features of the present invention which are believed to be novel are set forth with particularly in the appended claims.

Other objects and many of the attendant advantages will be more readily appreciated as the same becomes better understood by reference to the following detailed description and considered in connection with the accompanying drawing in which like reference symbols designate like parts throughout the figures.

DESCRIPTION OF THE PREFERRED EMBODIMENT

Figure 1:
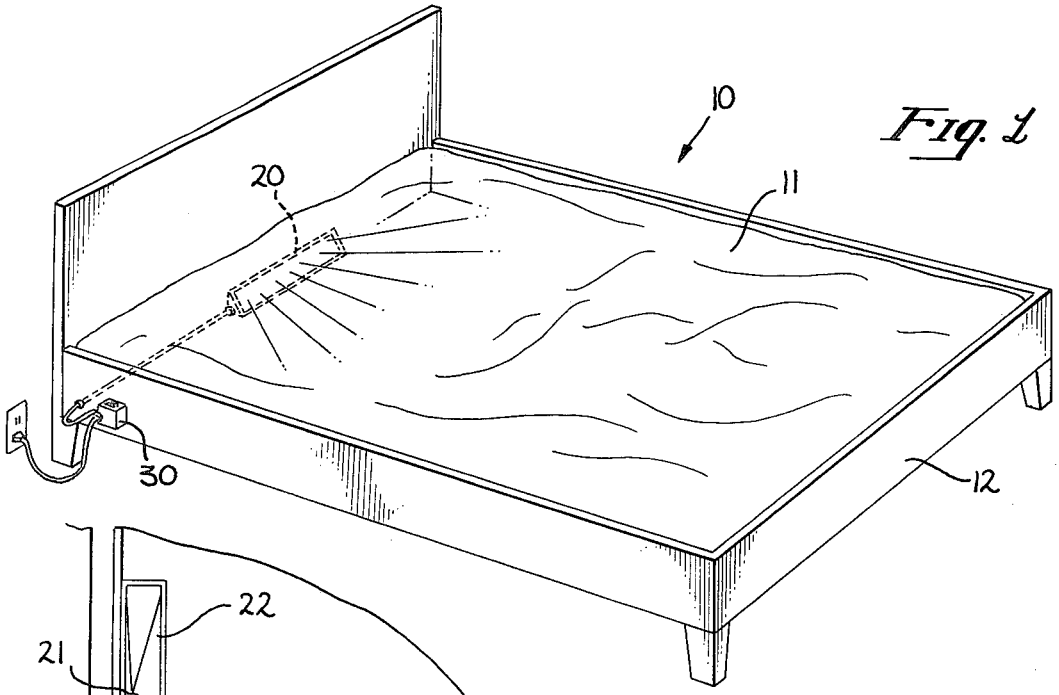
FIG. 1 is a perspective view of a waterbed having an illumination device which has been constructed in accordance with principles of the present invention.

In order to best understand the present invention it is necessary to read a description of its preferred embodiment in conjunction with the accompanying drawing. Referring to FIG. 1 the preferred embodiment of the present invention is an illumination device for use in combination with a waterbed which includes a plastic membrane 11 having the shape of a mattress when it is filled with water and being adapted to be filled with water and a frame 12 having a headboard, four legs and base which is adapted to receive the plastic membrane 11 after it has been filled with water. The illumination device includes a light source 20 which is optically coupled to the water in the plastic membrane 11 through the plastic membrane 11 and which is mechanically coupled to the headboard of the frame.

Figure 2:
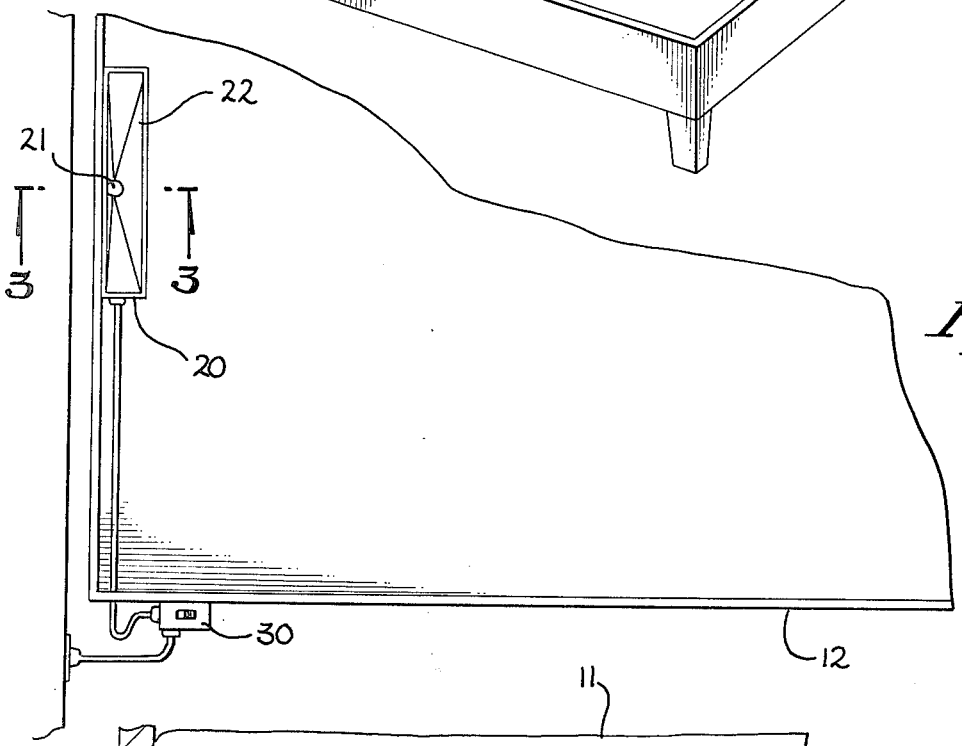
FIG. 2 is a partial, top plan view of the waterbed of FIG. 1.

Referring now to FIG. 2 the light source 20 includes a lamp 21 and a prism-shape container 22 in which the lamp 21 is disposed and through a glass sidewall 24 of which the lamp 21 is optically coupled to the water in the plastic membrane.

Still referring to FIG. 2 the illumination device also includes an electrical energy apparatus 30 for providing electrical energy to the lamp 21. The electrical energy apparatus 30 includes an on-off switch 31 which is electrically coupled to a wall outlet and a transformer for stepping down the current through the on-off switch. The transformer is electrically coupled to the lamp 22.

Figure 3:
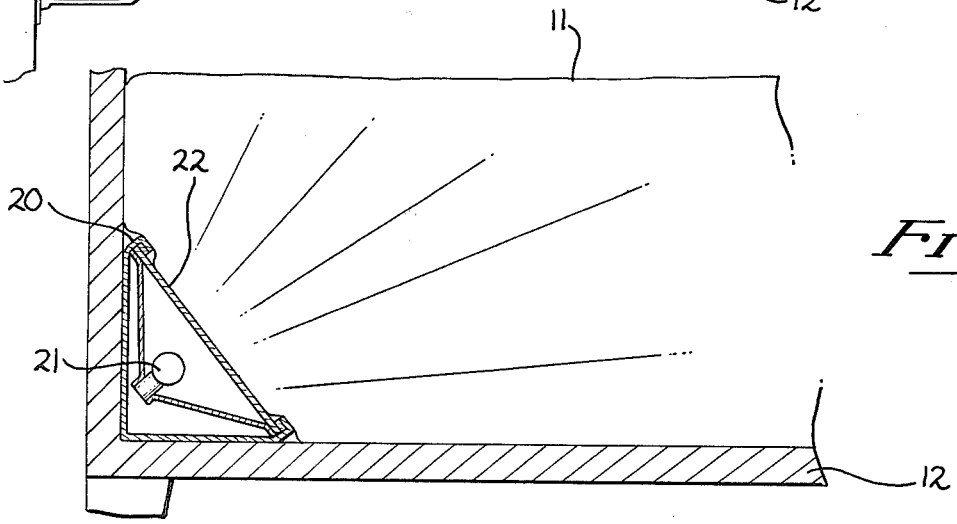
FIG. 3 is a partial, elevational view of the waterbed of FIG. 1 taken along line 3—3 of FIG. 2.

Referring now to FIG. 3 the illumination device shines light into the waterbed. The light is dispersed through the water thereby creating a waterbed which glows.

The inventors have found that the location of the light source is irrelevant as far as the glowing effect therefrom; however, they have found it to be more convenient to place the light source adjacent to the headboard of the frame. In the original embodiment the light source was a flashlight.

From the foregoing it can be seen that an illumination device for use in combination with a waterbed has been described. The advantage of the illumination device is that it provides an aesthetic experience for a waterbed user.

Accordingly it is intended that the foregoing disclosure and showing made in the drawing shall be considered only as an illustration of the present invention. Furthermore, it should be noted that the sketches are not drawn to scale and that distances of and between the various figures are not to be considered significant. The invention will be set forth with particularity in the appended claims.

What is claimed is:

1. An illumination device for use in combination with a waterbed which includes:

a. a plastic membrane which takes the shape of a mattress when it is filled with water and which is adapted to be filled with water; and b. a frame having a headboard, four legs and base which is adapted to receive the elastic membrane after it has been filed with water, said illumination device comprising:

a. a light source which is optically coupled to the water in the plastic membrane through the plastic membrane and which is mechanically coupled to the frame; and b. electrical energy means for providing electrical energy to said light source whereby said light source illuminates the water within the plastic membrane thereby producing a glowing effect.

2. An illumination device according to claim 1 wherein said light source comprises:

a. a lamp which is electrically coupled to said electrical energy means; and b. a prism-shape container in which said lamp is disposed and through a glass sidewall of which said lamp is optically coupled to the water in the plastic membrane.

3. An illumination device according to claim 2 wherein said electrical energy means comprises:

a. an on-off switch which is electrically coupled to a wall outlet; and b. a transformer for stepping down the current through said on-off switch, said transformer is electrically coupled to said lamp.

* * * * *